United States Patent [19]

Norris

[11] Patent Number: 4,898,298

[45] Date of Patent: Feb. 6, 1990

[54] FLYING INSECT CONTAINER GUARD

[76] Inventor: Annie B. Norris, 1708 S. Scott, South Bend, Ind. 46613

[21] Appl. No.: 330,220

[22] Filed: Mar. 29, 1989

[51] Int. Cl.[4] ..... A47G 19/22

[52] U.S. Cl. ..... 220/90.2; 215/100 R

[58] Field of Search ..... 220/90.2, 90.4, 90.6; 215/100 R

[56] References Cited

U.S. PATENT DOCUMENTS

| | | | |
|---|---|---|---|
| 110,148 | 12/1870 | Leach | 220/90.2 |
| 2,357,063 | 8/1944 | Swing | 220/90.4 |
| 3,185,341 | 5/1965 | Barbour | 220/90.2 |
| 3,362,572 | 1/1968 | Pelley | 220/90.2 |
| 3,806,023 | 4/1974 | Barnett | 220/90.2 |
| 3,940,012 | 2/1976 | Addington | 220/90.4 |
| 4,085,861 | 4/1978 | Ruff | 220/90.4 |

FOREIGN PATENT DOCUMENTS

| | | | |
|---|---|---|---|
| 2901559 | 7/1980 | Fed. Rep. of Germany | 220/90.2 |

*Primary Examiner*—George E. Lowrance
*Attorney, Agent, or Firm*—Leon Gilden

[57] ABSTRACT

A flying insect container guard is set forth comprising an annular guard formed with a downwardly extending skirt and an orthogonally upwardly positioned rim including a screen matrix of predetermined openings tapering downwardly into orifices to meter flow of fluid from an associated beverage container through the openings. A guard removal leg extends downwardly from the skirt for removal of the lid subsequent to use.

1 Claim, 1 Drawing Sheet

FLYING INSECT CONTAINER GUARD

BACKGROUND OF THE INVENTION

1. Field of the Invention

The field of invention relates to container guards, and more particularly pertains to a new and improved flying insect container guard to prevent intrusion of insects and access of such insects to the contents of a beverage container.

2. Description of the Prior Art

Various mesh-type guards have been utilized in the prior art. The prior art has heretofore utilized guards overlying containers to prevent contact of the contents of a container, but have heretofore failed to provide a container guard wherein the same is particularly oriented and arranged for securement to a beverage container including a seamed upper edge to prevent access of flying insects into the contents of the container which are attractive to such insects. Typically, beverages such as beer, flavored soft drinks, and the like create an attraction to flying insects which may at times become unapparent to the consumer of the contents until undesirable contact with such an insect is encountered.

For example, U.S. Pat. No. 110,148 to Leach sets forth a guard securable to a tea cup provided with a discontinuous rim for providing access to a consumer of the contents of the cup for overlying positioning of the tea cup and is further provided with an access opening for positioning of a spoon within the cup. The patent is of interest relative to the use of a drinking guard, but fails to provide the continuous construction of the instant invention and further fails to set forth the novel engagement and sealing structure of the instant invention, as well as the guard removal leg of the device set forth by the instant invention.

U.S. Pat. No. 1,269,902 to Butler sets forth a guard structure for securement to a drinking glass to prevent contact of ice and the like contained within the glass from contacting a user of the device.

U.S. Pat. No. 3,150,084 to Rodges sets forth an ice guard positioned to a rim of a glass preventing access of ice within the glass to a user of the glass. The guard is of a relatively remote organization relative to the instant invention, but is of interest relative to the noting of a drinking guard.

U.S. Pat. No. 3,240,348 to Serio sets forth yet another guard which is set forth as a strainer to prevent and minimize particles from within the container from passing outwardly thereof during the consuming of liquids from within the container.

U.S. Pat. No. 4,537,326 to Morehead sets forth a guard pivotally mounted overlying an opening of a beverage container wherein a guard is of a generally planar construction to cover the opening only of the container which is typically of a sealed and seamed container organization.

As such, it may be appreciated that there is a continuing need for a new and improved flying insect container guard wherein the same provides for a sealing engagement about the upper circumferential periphery of a seamed container, as well as employing a unique mesh grid for leavening fluid flow through the grid at a rate readily accommodated by a consumer of a beverage within the container.

SUMMARY OF THE INVENTION

In view of the foregoing disadvantages inherent in the known types of container guards now present in the prior art, the present invention provides a flying insect container guard wherein the same may be compactly stored when not in use and may be efficiently and readily secured in an overlying stealing engagement to an upper circumferential periphery of a beverage container. As such, the general purpose of the present invention, which will be described subsequently in greater detail, is to provide a new and improved flying insect container guard which has all the advantages of the prior art container guards and none of the disadvantages.

To attain this, the present invention comprises a guard including a cylindrical skirt with an inwardly directed overlying planar rim. Extending downwardly in a concave orientation relative to the rim is a mesh screen formed with a matrix of openings and including tapering sides extending inwardly and downwardly to a medial orientation relative to the opening of an orifice of a surface area less than that of said opening to meter fluid directed through the orifice and the opening and further prevent access of insects to the contents of the associated container. A downwardly extending leg aligned with the skirt is manually graspable to remove the guard, formed of a flexible polymeric-type material, from the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flying insect container guard which has all the advantages of the prior art container guards and none of the disadvantages.

It is another object of the present invention to provide a new and improved flying insect container guard which may be easily and efficiently manufactured and marketed.

It is a further object of the present invention to provide a new and improved flying insect container guard which is of a durable and reliable construction.

An even further object of the present invention is to provide a new and improved flying insect container guard which is susceptible of a low cost of manufacture with regard to both materials and labor, and which accordingly is then susceptible of low prices of sale to the consuming public, thereby making such flying insect container guard economically available to the buying public.

Still yet another object of the present invention is to provide a new and improved flying insect container guard which provides in the apparatuses and methods of the prior art some of the advantages thereof, while simultaneously overcoming some of the disadvantages normally associated therewith.

Still another object of the present invention is to provide a new and improved flying insect container guard wherein the same may be readily secured in an overlying relationship to a container and thereafter readily removed therefrom.

These together with other objects of the invention, along with the various features of novelty which characterize the invention, are pointed out with particularlity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
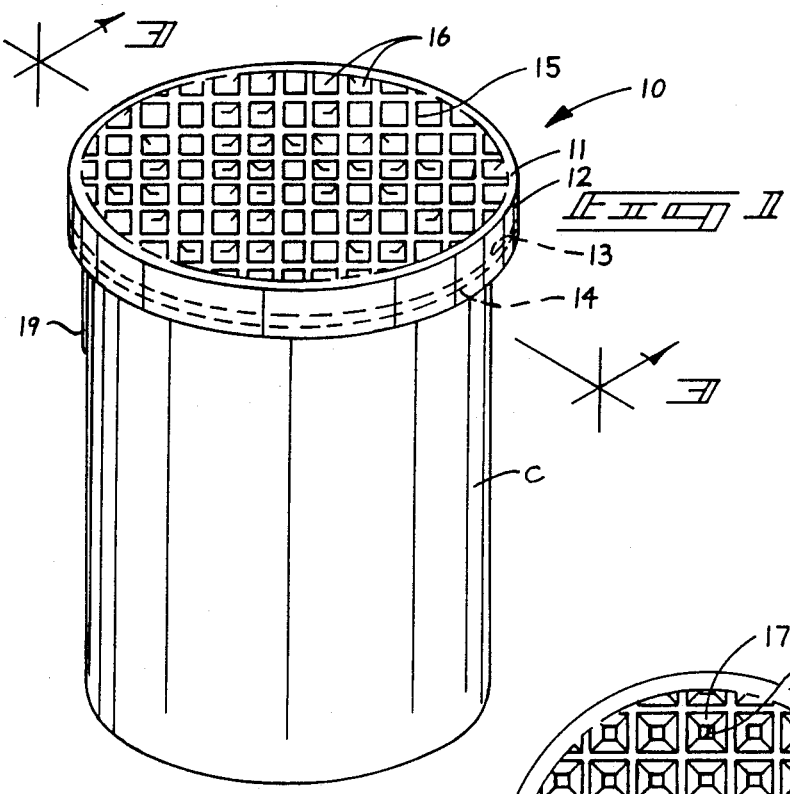
FIG. 1 is an isometric illustration of the instant invention.
Figure 2:
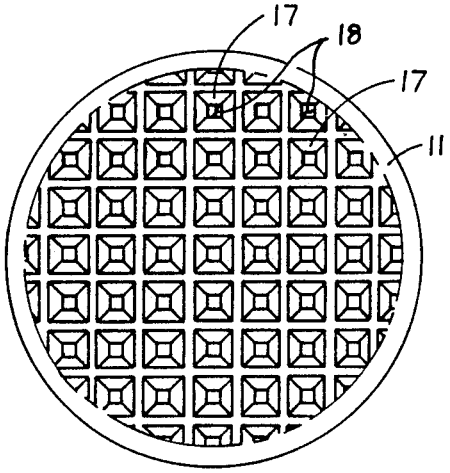
FIG. 2 is an orthographic top view of the instant invention.

With reference now to the drawings, and in particular to FIGS. 1 to 5 thereof, a new and improved flying insect container guard embodying the principles and concepts of the present invention and generally designated by the reference numeral 10 will be described.

More specifically, it will be noted that the flying insect container guard 10 essentially comprises a horizontally oriented planar rim 11 of circular configuration with a downwardly extending skirt orthogonally oriented relative to the planar rim. The skirt includes an exterior surface and an interior surface wherein the interior surface includes an inwardly directed circular abutment flange 13 parallel to the planar rim and spaced below the planar rim a distance equal to the concavity of the associated mesh screen 15. The mesh screen 15 is formed with a matrix of openings 16. The openings 16 include downwardly depending sides 17 directed to a medially oriented orifice 18 of the associated opening 16.

Spaced below the circular abutment flange 13 is an annular resilient seal 14 spaced above a lower edge of the skirt 12. The seal 14 is of a generally "O" ring configuration affixed within an annular groove 14a formed into the interior surface of the skirt above the lower edge of the skirt 12.

Figure 4:
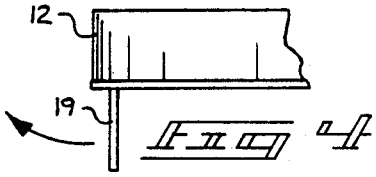
FIG. 4 is an orthographic view, taken partially in section, of the guard removal leg of the instant invention in a first position.
Figure 5:
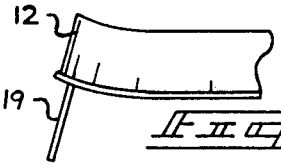
FIG. 5 is an orthographic view, taken partially in section, of the guard removal leg in a second position to remove the container guard from about an associated container.
Figure 3:
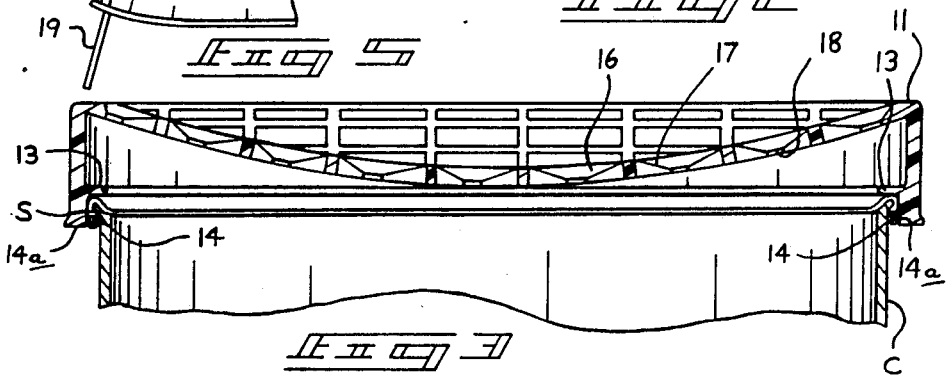
FIG. 3 is an orthographic view taken along the lines 3—3 of FIG. 1 in the direction indicated by the arrows.

A single downwardly depending leg 19 of planar construction depends in aligned orientation relative to the skirt 12. The leg 19 is pivotal from a first position, as illustrated in FIG. 4, with the skirt secured about the upper circumference surface of a container to a second position, as illustrated in FIG. 5, to pivot the container guard 10 outwardly relative to the container and thereby enhance removal of the container guard from the container subsequent to a drainage of the contents from within the container.

The container guard is formed of a generally flexible polymeric material to accommodate variations of construction of a container "C". The container "C" includes an outwardly extending seam "S" that is captured between the overlying abutment flange 13 and the underlying seal 14. In this manner, fluid directed overlying the surface of the container "C" will not seep about the sides of the container due to the sealing relationship of the seal 14 with the sides of the container "C".

As to the manner of usage and operation of the instant invention, therefore the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flying insect container guard in combination with a container, said container formed of a cylindrical configuration including an outwardly extending edge seam at an upper terminal end of container, and wherein said guard comprises, an annular skirt including engagement means for capturing said seam, and a continuous mesh screen integrally secured to an upper continuous interior edge of said skirt, and wherein said mesh screen is secured to an upper terminal edge of said skirt by an intermediate planar rim, and wherein said mesh screen is of a concave downwardly depending configuration relative to said skirt, and extends downwardly relative to said skirt, and wherein said engagement means includes a circular abutment flange means extending orthogonally interiorly of said skirt below said rim and above a lower terminal edge of said skirt to contact and abut an upper surface of said seam, and wherein said engagement means further includes a circular seal secured within a circular groove underlying the flange and spaced below the flange a distance equal to the width of the seam to capture the seam between the flange and the seal, and wherein said screen extends downwardly a distance equal to a length defined between the rim and an underlying surface of the flange to position the screen in an overlying contact to an upper surface of the container, and wherein the screen includes a matrix of openings, and wherein each of the openings include a plurality of inwardly tapering walls to define an orifice aligned with and underlying the opening for metering of fluid through the orifices to the opening, and further including a single downwardly depending leg aligned with the skirt in a first position and pivotal to a second position outwardly of the skirt to enable removal of the skirt from about the container, and wherein the skirt and screen are formed of a flexible material.

* * * * *